United States Patent [19]

Williams et al.

[11] 4,295,026

[45] Oct. 13, 1981

[54] SWITCH ADAPTER MECHANISM

[76] Inventors: Allen C. Williams; Barbara J. Williams, both of 322 W. Jefferson Ct., Vernon Hills, Ill. 60061

[21] Appl. No.: 91,378

[22] Filed: Nov. 5, 1979

[51] Int. Cl.[3] ..... H01H 3/04

[52] U.S. Cl. ..... 200/331

[58] Field of Search ..... 74/503; 200/330, 331, 200/252, 329

[56] References Cited

U.S. PATENT DOCUMENTS

| | | | |
|---|---|---|---|
| 2,668,456 | 2/1954 | Meistrell | 200/331 |
| 2,919,334 | 12/1959 | Jones | 200/331 |
| 3,581,037 | 5/1971 | Schiffelbein | 200/331 |
| 3,851,126 | 11/1974 | Keller | 200/329 |

*Primary Examiner*—John W. Shepperd
*Attorney, Agent, or Firm*—Marvin N. Benn & Assoc. Ltd.

[57] ABSTRACT

An adapter mechanism for enabling remote operation of a wall mounted toggle-type electrical switch comprises a cover plate having a pair of vertically spaced apertures receiving a pair of mounting screws rigidly securing the cover plate to the wall overlying the switch and an opening through which the switch lever passes. A slide plate is slidably interposed between the cover plate and the wall and includes a pair of vertically spaced longitudinal guide slots each receiving one of the mounting screws and an opening through which the switch lever passes. Both the cover plate and the slide include overlapping downward extensions, the cover plate extension being formed having a plurality of vertically spaced longitudinal slots and the slide plate extension being formed having a plurality of apertures each aligned with a respective one of the cover plate slots. An operating member extends loosely through a selected one of the cover plate slots and rigidly engages the associated slide plate aperture for enabling vertical displacement of the slide plate relative to the cover plate for remotely operating the switch lever.

5 Claims, 6 Drawing Figures

SWITCH ADAPTER MECHANISM

BACKGROUND OF THE INVENTION

The present invention relates generally to adapter mechanisms for facilitating the remote operation of a conventional wall mounted switch and, more particularly, to such adapter mechanisms which utilize a vertically reciprocable member operated by a control knob or handle disposed beneath the switch toggle lever.

Residential buildings are typically provided with a number of wall mounted electrical switches for operating lighting fixtures and various other electrical apparatus. Most commonly, switches used for this purpose include a toggle or lever pivotally operable in a vertical direction for making and breaking an electrical circuit to controllably operate an electrical device also connected in the circuit. It is accepted practice to locate such switches at a level most convenient for operation by adults, generally about 4½ feet above the floor. As a result, small children have difficulty reaching the switch lever for operating the same and all too often employ means such as a step stool or the like to provide an elevation from which the switch can be reached. Not infrequently, the consequences of such actions include injury to the child, especially when attempted in a darkened room. In addition, handicapped individuals in wheelchairs have difficulty reaching switch levers and many times require help in turning on or off a light switch.

In an attempt to remedy the foregoing situation, various adapter mechanisms have been proposed to facilitate the remote operation of a wall mounted switch lever by a small child. These prior art devices normally include a vertically reciprocable elongate member having means at one distal end for operatively engaging the switch lever and a control knob or handle secured to the opposite distal end and disposed a predetermined distance vertically beneath the switch. Thus, by operating the control knob for vertically displacing the elongate member, the switch may be conveniently turned on and off by a small child without resorting to dangerous elevation aids. For example, U.S. Pat. No. 2,668,456 to Meistrell discloses a switch operator comprising a rectangular housing having an upper end secured to the switch or outlet box and a downwardly disposed extension supporting a pivotally mounted control handle. An elongate link disposed within the housing connects the control handle to the switch lever permitting remote operation thereof in response to actuation of the pivotally operable control handle. This structure is rather complex mechanically and not very reliable when subjected to continued use. Also, no provisions are made for convenient adjustment of the height of the control handle above the floor.

Other prior art devices are taught in U.S. Pat. No. 2,582,379 to Goldberg and in U.S. Pat. No. 3,825,710 to Roberts et al. In both cases, the disclosed adapter mechanism comprises a slide plate having an upper portion secured overlying the switch face place and an integral downward extension rigidly supporting a distally disposed operating handle or knob. Also, in both cases, the slide plate includes an opening through which the switch toggle lever passes and a longitudinal slot through which the face plate mounting screw passes. As a result of this construction, the slide plates are vertically reciprocable between positions limited by the distal ends of the longitudinal slot in response to vertical displacement of the remote control knob. As in the case of the Meistrell device, however, the control handle of both of these mechanisms lack convenient vertical adjustment capabilities for accommodating different situations which might arise.

U.S. Pat. No. 3,188,439 to Fullerton discloses another extension apparatus using a vertically sliding member to operate the switch lever from a fixed remote position. In this device, a pair of T-blocks are secured to the switch plate, each including a pair of opposed shoulders slidably received with a channel carried by the slide member. This structure, in addition to not providing a vertically adjustable control handle, is complex mechanically and subject to slippage after repeated use. Other prior art devices employing techniques generally similar to those discussed above are disclosed in U.S. Pat. No. 3,839,615 to Bradford; U.S. Pat. No. 3,004,128 to Mikolajeski and U.S. Pat. No. 2,493,581 to Hood.

The improved remotely operable switch lever adapter mechanism of the present invention differs from the previously proposed devices discussed above in the provision of means allowing for convenient vertical adjustment of the adapter control knob, which purpose is achieved in a mechanical simple and extremely reliable structure.

SUMMARY OF THE INVENTION

According to the present invention there is provided an adapter mechanism for use with a wall mounted electrical switch of the type having a vertically pivotal operating lever, the adapter mechanism essentially comprising an elongate cover plate, an elongate slide plate and an operating member. The cover plate includes an upper portion disposed in the position otherwise occupied by the switch face plate and a depending lower extension, the lower extension including a plurality of vertically spaced longitudinal slots. The upper portion of the cover plate includes at least one mounting aperture axially aligned with a fastening aperture formed in the outlet box of the switch, both apertures receiving a mounting screw for stationarily securing the cover plate to the switch outlet box. The upper portion of the cover plate also includes an opening receiving the switch operating lever. The slide plate is interposed between the wall and the cover plate and includes at least one longitudinal guide slot receiving the mounting screw for allowing limited vertical displacement of the slide plate. The switch lever also passes through an opening formed in the slide plate such that the lever is operable in response to vertical movement of the slide plate. Finally, the slide plate includes a plurality of apertures each displaceable in a locus underlying a respective one of the cover plate longitudinal slots in response to vertical movement of the slide plate. The operating member comprises a horizontally disposed element passing through a selected one of the cover plate longitudinal slots and snugly engaging the associated slide plate aperture. As a result, the slide plate is vertically moveable for operating the switch lever in response to vertical displacement of the operating member while the cover plate remains stationary, the vertical height of the operating member above the floor being conveniently adjustable by passing the member through a desired one of the vertically spaced longitudinal cover plates slots and engaging the associated slide plate aperture.

DESCRIPTION OF THE PREFERRED EMBODIMENTS

Figure 1:
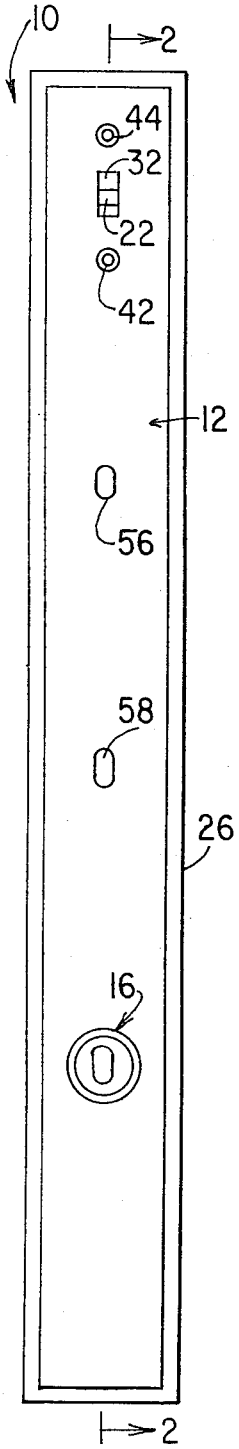
FIG. 1 is a front elevational view of the adapter mechanism of the invention mounted in association with a toggle-type wall switch, the switch being shown in its "off" position.
Figure 2:
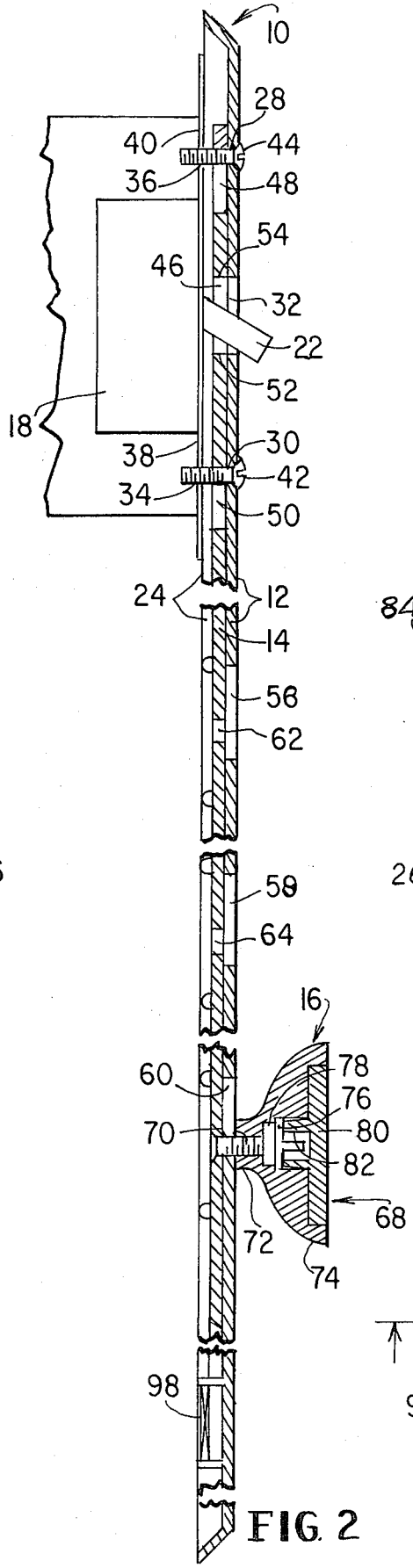
FIG. 2 is a cross-sectional view taken along line 2—2 of FIG. 1.

Referring now to the drawings, and particularly to FIGS. 1 and 2, the adapter mechanism 10 of the invention generally comprises an elongate cover plate 12, an elongate slide plate 14 and an operating member 16. The upper portion of the adapter mechanism 10 is mounted overlying a switch apparatus 18 carried within a wall mounted outlet box 20. The switch apparatus 18 is of the conventional type typically found in residential buildings and includes a toggle or lever 22 pivotally operable in a vertical direction for making and breaking an electrical circuit so as to controlably operate a lighting fixture or other electrical apparatus also connected in the circuit. As illustrated in FIGS. 1 and 2, the lever 22 is shown in its off position, its on position being achieved by vertical displacement thereof in an upwardly direction. Electrical switches of the illustrated type are normally mounted within the wall 24 such that the lever 22 is disposed from about four to five feet above the floor, the level most convenient for operation by adults. However, at the same time, operation of the switch is made difficult, if not impossible, for small children, handicapped persons confined to wheelchairs, and the like who cannot easily reach the lever 22. In order to resolve this situation, the adapter mechanism 10 includes a downwardly extending portion carrying the operating member 16 which may be vertically displaced for remotely operating the lever 22 and turning the switch apparatus 18 on and off, the switch apparatus also being locally operable through direct operation of the lever 22.

Referring in more detail to the drawings, the cover plate 12 comprises an elongate rectangular housing having a beveled perimeter 26. For esthetic purposes, the outwardly facing side of the cover plate 12 may be formed having a stippled texture or the like. The upper portion of the cover plate 12 includes a pair of vertically spaced fastening apertures 28 and 30 and an opening 32 disposed therebetween. The fastening apertures 28 and 30 are arranged to lie in coaxial alignment with a pair of vertically spaced apertures 34 and 36 formed in the projecting shoulders 38 and 40 of the switch apparatus 18. A pair of mounting screws 42 and 44, which may be somewhat longer than the screws normally used to mount the conventional face plate to the wall 24, pass through the cover plate fastening apertures 28 and 30 and through the apertures 34 and 36 for rigidly securing the cover plate 12 in relation to the wall 24. When secured to the wall 24 in this manner, the opening 32 of the cover plate 12 is adapted for receiving the lever 22 of the switch 18 as shown in FIGS. 1 and 2. The opening 32 is of sufficient longitudinal extent to enable the lever 22 to occupy its off position, as shown in FIGS. 1 and 2, and also its on position.

The slide plate 14 also comprises an elongate rectangular structure but its dimensions, both longitudinal and transverse, are somewhat smaller than the corresponding dimensions of the cover plate 12. The upper portion of the slide plate 14 includes an opening 46 corresponding to the opening 32 of the cover plate 12 and a pair of vertically spaced longitudinal guide slots 48 and 50. The guide slots 48 and 50 are arranged so that in the assembled configuration of the adapter mechanism 10, the mounting screws 42 and 44 pass through the longitudinal guide slots 48 and 50 as well as the cover plate apertures 28 and 30 and the apertures 34 and 36. The slide plate 14 is therefore vertically slidable relative to the cover plate 12 and to the wall 24, the longitudinal guide slots 48 and 50 defining the limits of vertical displacement thereof. In its position shown in FIGS. 1 and 2, the slide plate 14 is disposed in its lowest vertical position. When the slide plate 14 is displaced upwardly from this position, the lower shoulder 52 of the opening 46 bears against the lever 22 forcing it to pivot upwardly for turning the switch apparatus 18 to its on position. From this upwardly position, the slide plate 14 may be vertically displaced in a downwardly direction wherein the upper shoulder 54 of the opening 46 bears against the lever 22 for returning it to its off position. It will therefore be seen that the switch lever 22 may be operated for turning the switch apparatus 18 on and off by appropriately vertically displacing the slide plate 14 relative to the cover plate 12 and the wall 24.

The downwardly extending portion of the cover plate 12 includes three vertically spaced longitudinal slots 56, 58, and 60. The downwardly extending portion of the slide plate 14 includes three corresponding apertures 62, 64 and 66. In particular, the longitudinal slots 56, 58, and 60 and the apertures 62, 64 and 66 are arranged so that each of the apertures are displaceable in a locus underlying a respective one of the cover plate longitudinal slots in response to vertical displacement of the slide plate. A control knob 68 is rigidly secured to the slide plate 14 by a mounting screw 70 which is inserted from the wall side of the slide plate 14 through a selected one of the apertures 62, 64 and 66 for engaging the control knob 68. The control knob 68 includes a neck 72 for receiving the mounting screw 70, the neck 72 of the control knob 68 extending through the longitudinal slot 56, 58 or 60 associated with the aperture receiving the mounting screw 70. The width of the neck 72 of the control knob 68 is about one-half the longitudinal dimension of the slots 56, 58 and 60 whereby the neck 72 is free to travel within the longitudinal slots 56, 58 and 60 of the cover plate 12 in response to vertical displacement of the control handle 68. The control knob 68 further comprises a generally circular outer shell 74 including a central depression 76 at the bottom of which is molded a nut 78 for receiving and securing the mounting screw 70 to the control knob 68. A knob insert 80 having a projecting portion 82 forming a friction fit with the depression 76 of the shell 74 encloses the depression 76 together with the nut 78.

From the above, it will be seen that the control knob 68 is rigidly secured to the slide plate 14 but allowed to freely travel within the associated longitudinal slot 56, 58 or 60 of the cover plate 12. Therefore, for example, a child can easily grasp the control knob 68 and vertically displace the same thereby causing the slide plate 14 to be displaced relative to the cover plate 12 in a corresponding direction. Displacement of the slide plate 14, in turn, results in remote operation of the lever 22 of the switch apparatus 18 as previously discussed. Moreover, to accommodate for different sizes of children and the like, the vertical position of the control knob 68 is adjustable to any one of three different positions. That is, the control knob 68 may pass through longitudinal slot 56 of the cover plate 12 for connection to aperture 62 of the slide plate 14, through longitudinal slot 58 of the cover plate 12 for connection to the aperture 64 of the slide plate 14 or through longitudinal slot 60 of the cover plate 12 for connection to the aperture 66 of the slide plate 14. This adjustment is conveniently facilitated by initially selecting the cover plate longitudinal slot and associated slide plate aperture most nearly corresponding to the control knob height desired. The mounting screw 70 is subsequently inserted through the selected slide plate aperture and mated with the control knob 68 whose neck 72 is disposed within the associated cover plate longitudinal slot. Height adjustments of the control knob 68 may thereby be easily and conveniently accomplished as desired.

Figure 3:
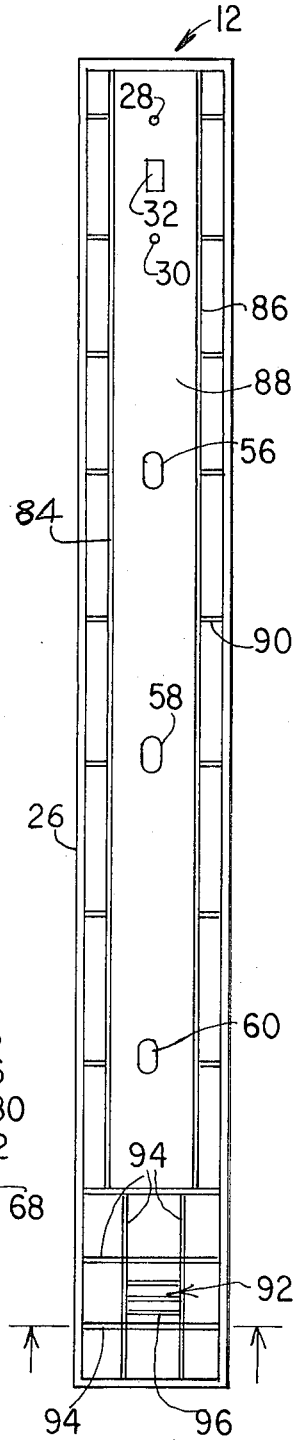
FIG. 3 is a rear elevational view of the interior surface or side of the cover plate of the adapter mechanism shown in FIG. 1.

The interiorly facing side of the cover plate 12 is illustrated in detail in FIG. 3. To improve the structural stability of the adapter mechanism 10, this surface of the cover plate 12 includes a pair of longitudinal ribs 84 and 86 defining a central area 88 approximately the size of the slide plate 14. A plurality of transverse ribs 90 are formed externally of the central area 88 between the beveled circumference 26 and the longitudinal ribs 84 and 86. These transverse ribs 90 bear upon the wall 24 to provide added strength for the adapter mechanism 10. The portion of the cover plate 12 extending below the slide plate 14 also includes a smaller central area 92 defined by a series of intersecting longitudinal and transverse ribs 94. A series of shorter ribs 96 are transversely disposed within the central area 92. A double sided adhesive pad 98 is attached to the ribs 96 of the central area 92 and to the wall 24 for securing the lower end of the cover plate 12 to the wall 24.

Figure 4:
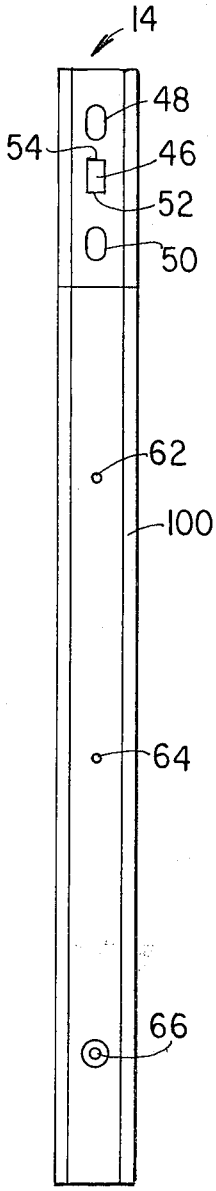
FIG. 4 is a rear elevational view of the interior surface or side of the slide plate of the adapter mechanism shown in FIG. 1.

Referring to FIG. 4, the interior surface of the slide plate 14 may include two space rails 100 disposed along the length of the slide plate 14 as shown. The space rails 100 are coupled or molded into slide plate 14 to serve to suitably space the slide plate 14 from the wall 24.

Figure 5:
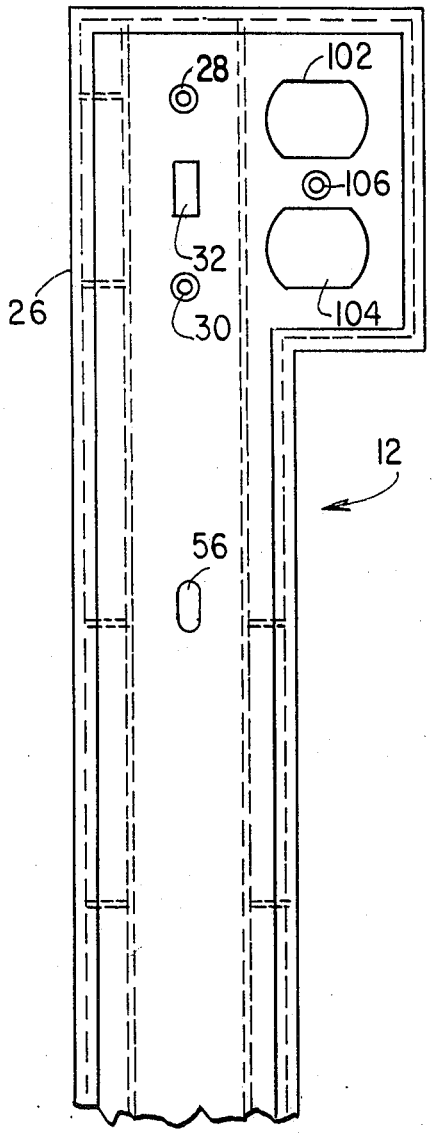
FIG. 5 is a partial front elevational view illustrating a modified embodiment of the adapter mechanism of FIG. 1.
Figure 6:
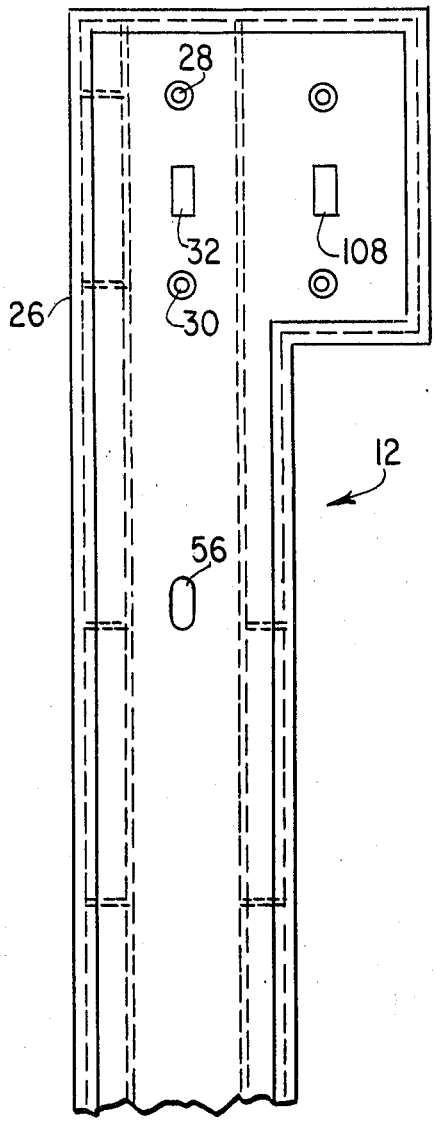
FIG. 6 is a partial front elevational view illustrating another modified embodiment of the adapter mechanism of FIG. 1.

FIGS. 5 and 6 illustrate two modifications of the adapter mechanism 10 discussed above. In each of these modifications, the slide plate 14 and control knob 68 remains unchanged but the cover plate 12 takes on a slightly different configuration from that previously discussed. In particular, the cover plate in each case is slightly modified to accommodate different types of wall outlets frequently found in residential buildings. For example, in FIG. 5, the cover plate 12 has been modified to accommodate an electrical outlet of the type having the conventional switch together with an adjacent pair of vertically displaced electrical power outlets. To accommodate the power outlets, the upper portion of the cover plate 12 has been transversely extended, with the extended section having suitably formed openings 102 and 104 for exposing the power outlets. An opening 106 is also provided for receiving a mounting screw to secure the transversely extending portion to the outlet box.

In FIG. 6, the cover plate 12 has been modified to accommodate an adjacent double switch arrangement. In this modification the upper portion of the cover plate has been transversely extended, the transverse extension including an opening 108 for receiving the switch lever of the second switch. It will be appreciated that without modification of the slide plate 14, the second switch is only locally operable and will not be affected through operation of the control knob 68.

What has thus been shown is an improved adapter mechanism for allowing remote operation of a wall mounted toggle-type switch in response to a control knob vertically displaced at an adjustable position below the switch assembly.

Obviously, the specific designs for each of the elements illustrated in the accompanying drawings are non-limiting, as other alternatives in addition to those discussed above will be obvious to those skilled in the art. Since such modifications can be made by those skilled in the prior art without departing from the purview of this invention, it is intended that the subject invention only be limited to the invention as set forth in the following claims.

What is claimed is:

1. Apparatus for use with a wall mounted switch of the type having an outlet box including at least one fastening aperture adapted for receiving a cover plate mounting screw and a vertically moveable operating level for turning the switch on and off, said apparatus comprising:

an elongate cover plate having an upper portion disposed overlying said outlet box and a lower portion depending therefrom, said upper portion including at least one mounting aperture adapted for receiving said mounting screw for stationarily securing said cover plate to said outlet box and an opening receiving said operating level for allowing local manual operation of said switch, said lower portion including a plurality of vertically spaced longitudinal slots;

an elongate slide plate interposed between the wall and said cover plate, said slide plate including at least one longitudinal guide slot receiving said mounting screw for allowing limited vertical displacement of said slide plate relative to said cover plate, an opening receiving said lever for operating said switch in response to vertical movement of said slide plate, and a plurality of apertures each displaceable in a locus underlying a respective one of said cover plate longitudinal slots in response to vertical movement of said slide plate; and a single horizontally disposed operating member passing through a selected one of said cover plate longitudinal slots and snugly engaging the associated one of said slide plate apertures, said slide plate being moveable for operating said switch in response to vertical displacement of said operating member from an adjustable height above the floor corresponding to said selected cover plate longitudinal slot while said cover plate is maintained in a stationary orientation.

2. The apparatus according to claim 1 including an operating knob secured to said horizontal operating member exteriorly of said cover plate for facilitating manual operation of operating member.

3. The apparatus according to claim 2 wherein said cover plate and said slide plate are both generally rectangular in shape.

4. The apparatus according to claim 3 wherein said cover plate completely covers said slide plate from view when said apparatus is mounted in association with said switch.

5. The apparatus according to claim 4 including means for securing said lower portion of said cover plate to said wall.

* * * * *